US009408434B2

(12) United States Patent
Su

(10) Patent No.: US 9,408,434 B2
(45) Date of Patent: Aug. 9, 2016

(54) FOOTWEAR

(71) Applicant: Johnson Su, Taichung (TW)

(72) Inventor: Johnson Su, Taichung (TW)

( * ) Notice: Subject to any disclaimer, the term of this patent is extended or adjusted under 35 U.S.C. 154(b) by 383 days.

(21) Appl. No.: 14/070,701

(22) Filed: Nov. 4, 2013

(65) Prior Publication Data

US 2014/0310990 A1 Oct. 23, 2014

(30) Foreign Application Priority Data

Apr. 19, 2013 (TW) ..... 102207227 U

(51) Int. Cl.

| | |
|---|---|
| ***A43B 5/08*** | (2006.01) |
| ***A43B 3/12*** | (2006.01) |
| ***A43B 3/24*** | (2006.01) |
| ***A43B 7/08*** | (2006.01) |
| ***A43B 13/26*** | (2006.01) |
| ***A43B 13/36*** | (2006.01) |

(52) U.S. Cl.

CPC . *A43B 5/08* (2013.01); *A43B 3/128* (2013.01); *A43B 3/244* (2013.01); *A43B 3/246* (2013.01); *A43B 7/087* (2013.01); *A43B 13/26* (2013.01); *A43B 13/36* (2013.01)

(58) Field of Classification Search

CPC ..... A43B 3/244; A43B 3/246; A43B 5/08; A43B 13/16; A43B 13/24; A43B 13/26; A43B 13/28; A43B 3/128

USPC ..... 36/100, 8.1, 101

See application file for complete search history.

(56) References Cited

U.S. PATENT DOCUMENTS

| | | | | |
|---|---|---|---|---|
| 6,701,640 | B2 * | 3/2004 | Nakano | A43B 7/06 36/3 B |
| 6,915,596 | B2 * | 7/2005 | Grove | A43B 13/223 36/100 |
| 7,451,557 | B2 * | 11/2008 | McDonald | A43B 1/0063 36/100 |
| 7,578,076 | B2 * | 8/2009 | Pawlus | A43B 3/0047 36/100 |
| 8,474,155 | B2 * | 7/2013 | McDonald | A43B 1/0063 36/102 |

* cited by examiner

*Primary Examiner* — Ted Kavanaugh
(74) *Attorney, Agent, or Firm* — Trop Pruner & Hu, P.C.

(57) ABSTRACT

A footwear includes an outsole and an insole. The outsole includes multiple support portions connected to an annular peripheral portion, and cooperating with a hole-defining surface to define multiple block-receiving holes, and an annular inner ridge extending from the hole-defining surface into the holes. The insole includes multiple wearproof blocks and an insole body formed with an annular outer groove and multiple embedding grooves between adjacent pairs of the wearproof blocks. The insole body is supported by the support portions and the peripheral portion with the inner ridge received in the outer groove, the support portions received in the embedding grooves, and the wearproof blocks received fittingly in the holes.

16 Claims, 5 Drawing Sheets

FOOTWEAR

CROSS-REFERENCE TO RELATED APPLICATION

This application claims priority of Taiwanese Patent Application No. 102207227, filed on Apr. 19, 2013.

BACKGROUND OF THE INVENTION

1. Field of the Invention

The invention relates to a footwear, more particularly to a footwear suitable for water sports and/or water activities.

2. Description of the Related Art

A conventional shoe for wading as disclosed in Taiwanese Patent No. 373450 includes a sole, an upper integrated with a top portion of the sole, and an anti-slipping mat integrated with a bottom portion of the sole. If the upper and the anti-slipping mat are glued to the sole, the glue will gradually lose its adhesive strength after the conventional shoe has been soaked in water, thus shortening the service life of the conventional shoe. If the upper and the anti-slipping mat are to be sewn to the sole, due to the overall thickness of the conventional shoe, the sewing process would be rather difficult.

Another conventional shoe for wading as disclosed in Taiwanese Patent No. M377900 includes an insole that is stacked on and fixed to a top portion of an outsole with adhesive which will also gradually lose its adhesive strength after the conventional shoe has been soaked in water, thus shortening the service life of the conventional shoe. If sewing is used instead, the result is similar to that of the conventional shoe previously mentioned. Therefore, these conventional shoes could only be made into "flip-flops," limiting the functionality and wearing stability thereof, especially during water sports and/or activities, where the conventional shoe is likely to slide off a user's foot and possibly get lost.

SUMMARY OF THE INVENTION

Therefore, the object of the present invention is to provide a shoe that can eliminate the aforesaid drawbacks of the prior art.

According to the present invention, there is provided a footwear suitable for water sports/activities that includes an outsole, an insole and an upper.

The outsole includes an annular peripheral portion, a plurality of support portions and an annular inner ridge. The annular peripheral portion has a hole-defining surface. The support portions respectively extend in directions substantially perpendicular to a longitudinal direction of the shoe, are each connected at two ends to the annular peripheral portion, and cooperate with the hole-defining surface of the annular peripheral portion to define a plurality of block-receiving holes. The annular inner ridge protrudingly extends from the hole-defining surface of the annular peripheral portion into the block-receiving holes.

The insole includes an insole body formed with an annular outer groove and a plurality of wearproof blocks connected to the insole body. The insole is formed with a plurality of embedding grooves between adjacent pairs of the wearproof blocks. The insole body is supported by the support portions and the annular peripheral portion with the annular inner ridge received fittingly in the annular outer groove, the support portions received respectively and fittingly in the embedding grooves, and the wearproof blocks received respectively and fittingly in the block-receiving holes. The upper is fixed on the outsole.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
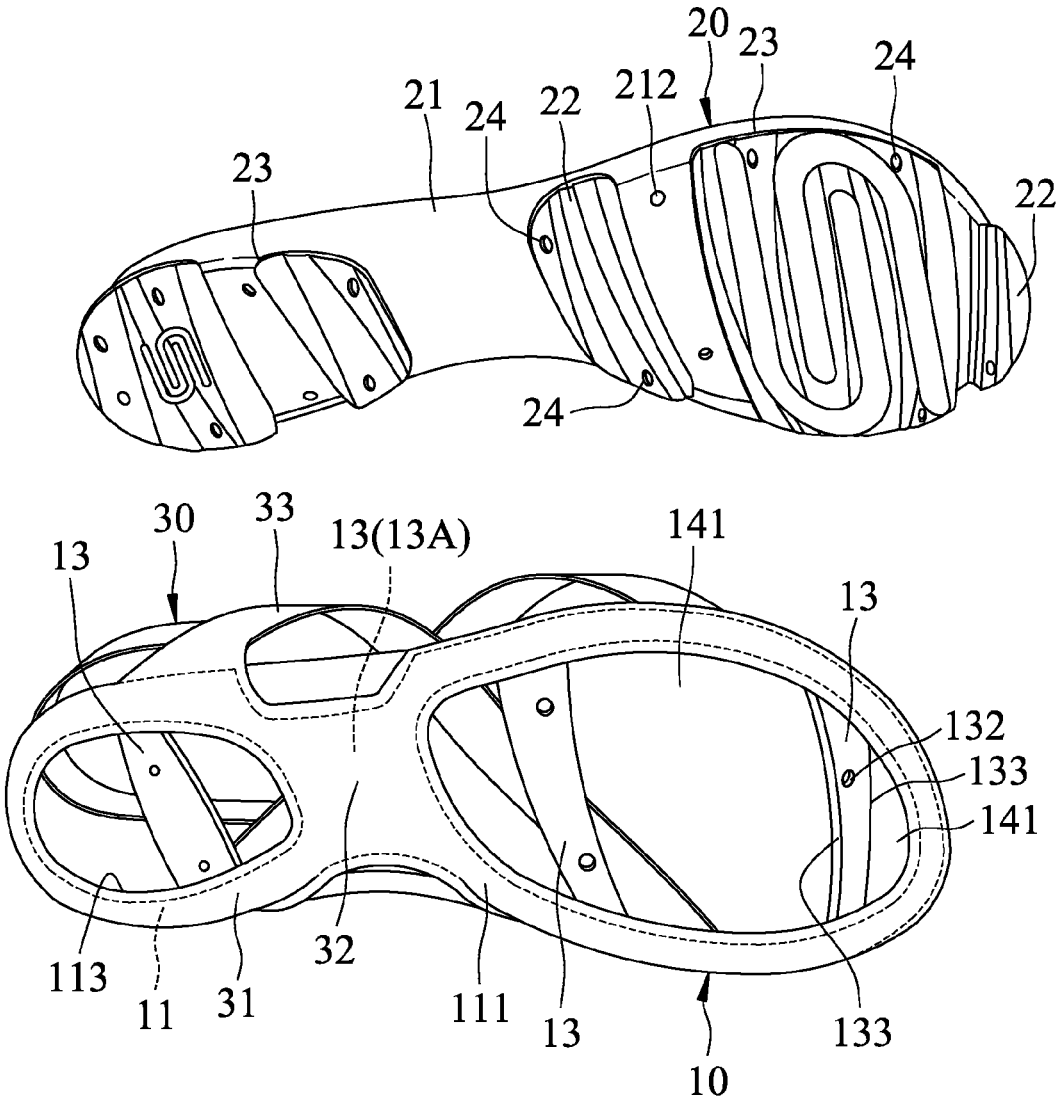
FIG. 1 is a partly exploded perspective view of a preferred embodiment of a footwear suitable for water sports according to the present invention.
Figure 2:
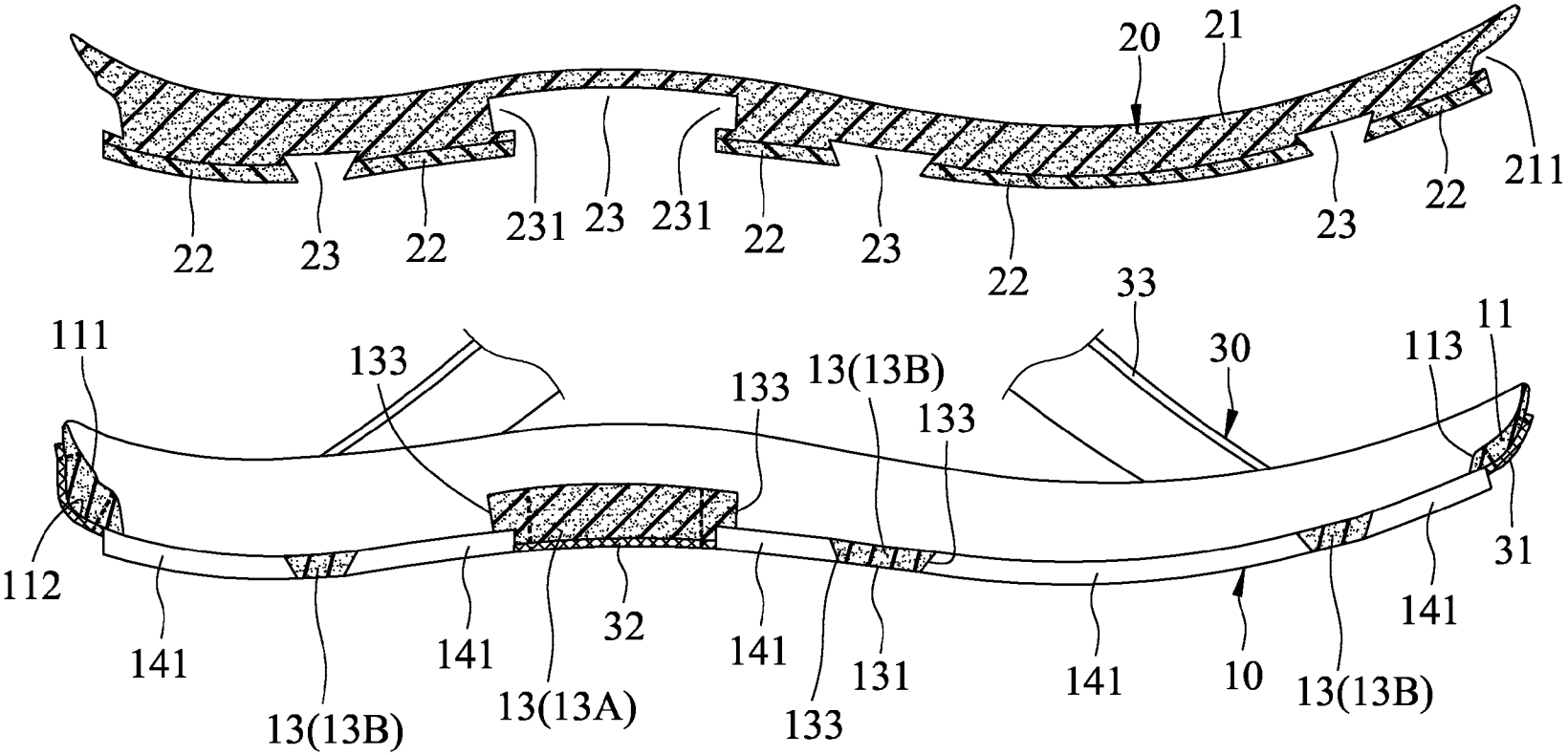
FIG. 2 is a partly exploded sectional view of the preferred embodiment.

Referring to FIGS. 1 and 2, a preferred embodiment of a footwear according to the present invention includes an outsole 10, an insole 20 and an upper 30.

The outsole 10 includes an annular peripheral port ion 11, a plurality of support portions 13, and an annular inner ridge 113.

The annular peripheral portion 11 has a hole-defining surface 111. The support portions 13 respectively extend in directions substantially perpendicular to a longitudinal direction of the footwear, are each connected at two ends to the annular peripheral portion 11, and cooperate with the hole-defining surface 111 of the annular peripheral portion 11 to define a plurality of block-receiving holes 141. The annular inner ridge 113 protrudingly extends from the hole-defining surface 111 of the annular peripheral portion 11 into the block-receiving holes 141. One of the support portions 13A that is disposed proximate to a middle section of the annular peripheral portion 11 is greater in size than the remaining one(s) of the support portions 13B. Each of the support portions 13B protrudes downwardly from the bottom side of the annular peripheral portion 11 and from the support portion 13A.

Figure 3:
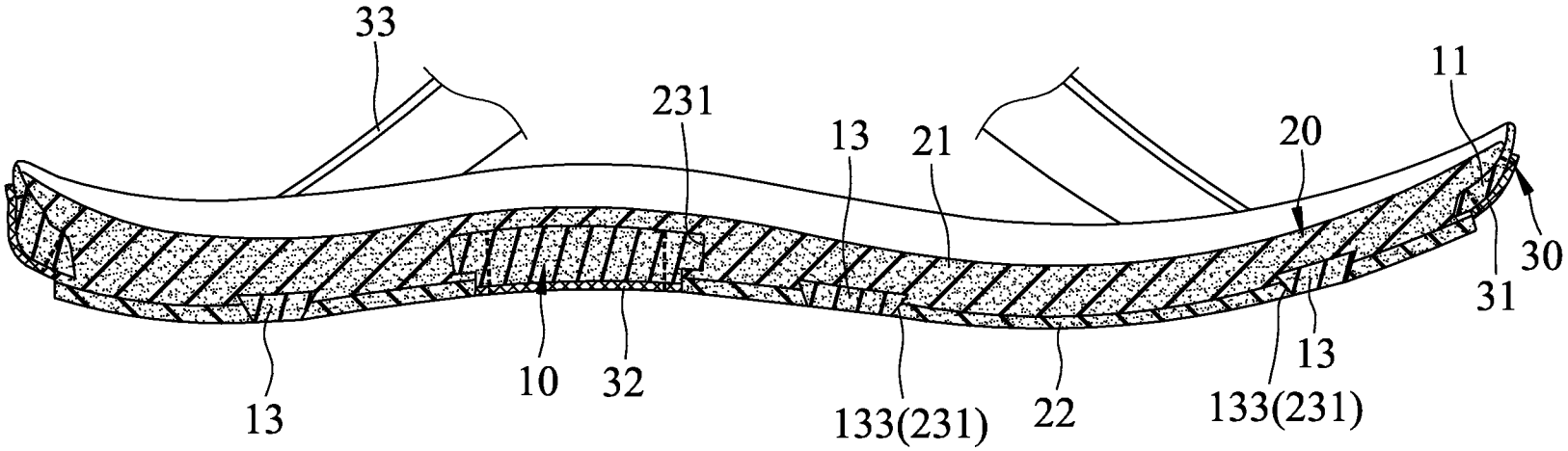
FIG. 3 is an assembled sectional view of the preferred embodiment.
Figure 4:
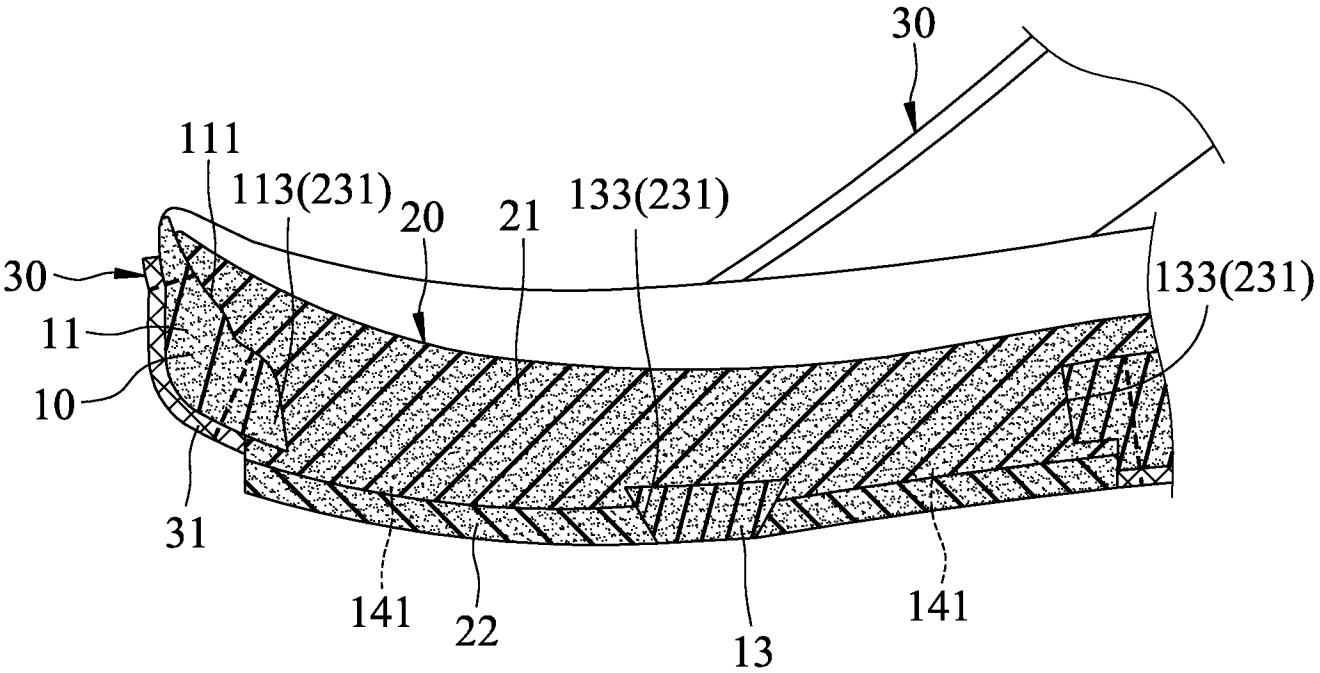
FIG. 4 is a partially enlarged view of FIG. 3.
Figure 5:
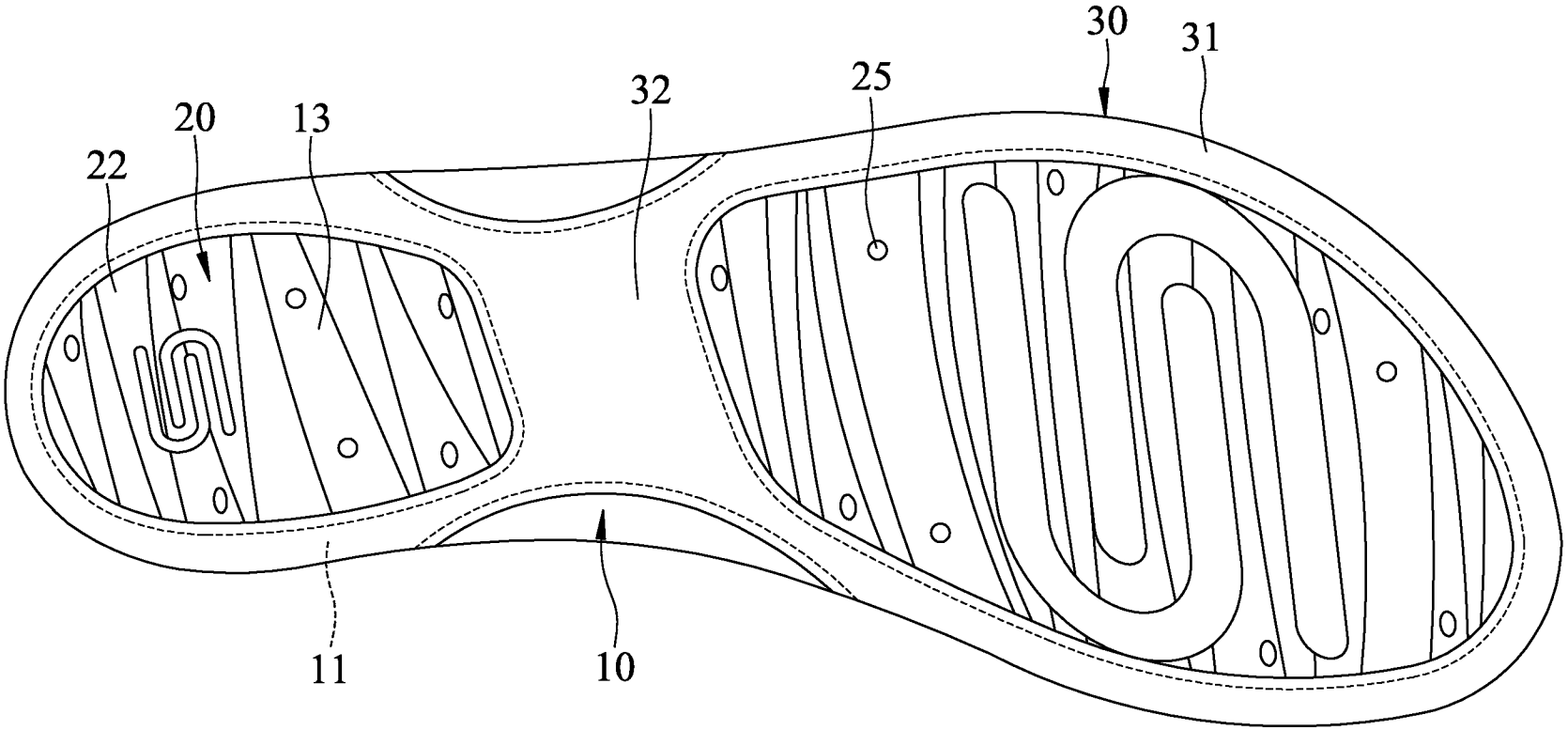
FIG. 5 is a bottom view of the preferred embodiment.

Further referring to FIGS. 3, 4 and 5, the insole 20 includes an insole body 21 that is formed with an annular outer groove 211, and a plurality of wearproof blocks 22 that are connected to the insole body 21. The insole body 21 is made of a soft and comfortable material whereas the wearproof blocks 22 are made of wear-resistant material. The insole 20 is formed with a plurality of embedding grooves 23 between adjacent pairs of the wearproof blocks 22. The insole body 21 is supported by the support portions 13 and the annular peripheral portion 11 with the annular inner ridge 113 received fittingly in the annular outer groove 211, the support portions 13 received respectively and fittingly in the embedding grooves 23, and the wearproof blocks 22 received respectively and fittingly in the block-receiving holes 141. In this embodiment, the insole body 21 and the wearproof blocks 22 of the insole 20 are made of different materials and are molded as one piece.

In this embodiment, each of the embedding grooves 23 has two inner recessed portions 231 respectively concaved in forward and rearward directions such that the embedding groove 23 has a restricted opening at a bottom side of the insole 20. Each of the support portions 13 includes two engaging protrusions 133 that respectively and protrudingly extend in the forward and rearward directions and that respectively and embeddingly engage the inner recessed portions 231 of the respective one of said embedding grooves 23.

In addition, the insole 20 is further formed with a plurality of first draining holes 24 extending through the insole body 21 and through the wearproof blocks 22. The support portions 13 of the outsole 10 are formed with at least one first through hole 132, and the insole body 21 is further formed with at least one second through hole 212 registered with and in spatial communication with the first through hole 132, thus cooperatively forming at least one second draining hole 25 in the insole 20.

The upper 30 is fixed on the outsole 10, and includes an annular bottom piece 31 sewn to the bottom side of the annular peripheral portion 11, a connecting piece 32 sewn to the support portion 13A and connected to the annular bottom piece 31, and an upper piece 33 connected to the annular bottom piece 31 and disposed above the annular peripheral portion 11.

Before the insole 20 is assembled to the outsole 10, the annular bottom piece 31 and the connecting piece 32 of the upper 30 are sewn to the annular peripheral portion 11 and the support portion 13A.

With reference to FIGS. 3 and 4, to assemble the insole 20 and the outsole 10, the insole 20 is pushed downward such that the insole body 21 is supported by the support portions 13 and the annular peripheral portion 11, that the annular inner ridge 113 is received fittingly in the annular outer groove 211, that the support portions 13 are received respectively and fittingly in the embedding grooves 23, and that the wearproof blocks 22 are received respectively and fittingly in the block-receiving holes 141 as previously described, thereby firmly assembling the outsole 10, the insole 20, and the upper 30 together to form the footwear. It is worth mentioning that, while the upper 30 is sewn onto the outsole 10 in the preferred embodiment, the same may also be combined to the outsole 10 in alternative ways, such as being tied, embedded (not shown).

Accordingly, the advantages of the present invention are summarized as follows:

A) Due to the embedding coupling between the wearproof blocks 22 and the block-receiving holes 141, between the support portions 13 and the embedding grooves 23, and between the annular inner ridge 113 and the annular outer groove 211, the insole 20 is easily secured onto the outsole 10. Therefore, no adhesive is needed for the assembly of the footwear of this invention, no unglue would occur, and longer service life is provided.

B) The thickness of the annular peripheral portion 11 of the outsole 10 may be kept small to permit easy sewing of the upper 30 to the annular peripheral portion 11 without jeopardizing the engagement between the insole 20 and the outsole 10.

C) Unlike the prior art, the footwear of this invention is not limited to a flip-flop. Therefore, the upper 30 can be made to cover a majority of a foot of a user to prevent the footwear from falling off.

What is claimed is:

1. A footwear comprising:

an outsole including an annular peripheral portion that has a hole-defining surface, a plurality of support portions that respectively extend in directions substantially perpendicular to a longitudinal direction of said footwear, that are each connected at two ends to said annular peripheral portion, and that cooperate with said hole-defining surface of said annular peripheral portion to define a plurality of block-receiving holes, and an annular inner ridge that protrudingly extends from said hole-defining surface of said annular peripheral portion into said block-receiving holes;

an insole including an insole body that is formed with an annular outer groove, and a plurality of wearproof blocks that are connected to said insole body, said insole being formed with a plurality of embedding grooves between adjacent pairs of said wearproof blocks, said insole body being supported by said support portions and said annular peripheral portion with said annular inner ridge received fittingly in said annular outer groove, said support portions received respectively and fittingly in said embedding grooves, and said wearproof blocks received respectively and fittingly in said block-receiving holes, such that said wearproof blocks protrude from a bottom side of said annular peripheral portion; and an upper fixed on said outsole;

wherein each of said embedding grooves has two inner recessed portions respectively concaved in forward and rearward directions such that said embedding groove has a restricted opening at a bottom side of said insole, and each of said support portions includes two engaging protrusions that respectively and protrudingly extend in the forward and rearward directions and that respectively and embeddingly engage said inner recessed portions of the respective one of said embedding grooves.

2. The footwear as claimed in claim 1, wherein one of said support portions that is disposed proximate to a middle section of said annular peripheral portion is greater in size than the remaining one(s) of said support portions.

3. A footwear comprising:

an outsole including an annular peripheral portion that has a hole-defining surface, a plurality of support portions that respectively extend in directions substantially perpendicular to a longitudinal direction of said footwear, that are each connected at two ends to said annular peripheral portion, and that cooperate with said hole-defining surface of said annular peripheral portion to define a plurality of block-receiving holes, and an annular inner ridge that protrudingly extends from said hole-defining surface of said annular peripheral portion into said block-receiving holes;

an insole including an insole body that is formed with an annular outer groove, and a plurality of wearproof blocks that are connected to said insole body, said insole being formed with a plurality of embedding grooves between adjacent pairs of said wearproof blocks, said insole body being supported by said support portions and said annular peripheral portion with said annular inner ridge received fittingly in said annular outer groove, said support portions received respectively and fittingly in said embedding grooves, and said wearproof blocks received respectively and fittingly in said block-receiving holes, such that said wearproof blocks protrude from a bottom side of said annular peripheral portion; and an upper fixed on said outsole;

wherein one of said support portions that is disposed proximate to a middle section of said annular peripheral portion is greater in size than the remaining one(s) of said support portions; and wherein each of said support portions other than said one of said support portions protrudes downwardly from said bottom side of said annular peripheral portion and from said one of said support portions.

4. The footwear as claimed in claim 3, wherein said upper includes an annular bottom piece sewn to said bottom side of said annular peripheral portion, and an upper piece connected to said annular bottom piece and disposed above said annular peripheral portion.

5. The footwear as claimed in claim 3, wherein said insole is further formed with a plurality of first draining holes extending through said insole body and said wearproof blocks.

6. The footwear as claimed in claim 5, wherein said support portions of said outsole are formed with at least one first through hole, and said insole body is further formed with at least one second through hole registered with and in spatial communication with said first through hole.

7. The footwear as claimed in claim 3, wherein said insole body and said wearproof blocks of said insole are made of different materials and are molded as one piece.

8. The footwear as claimed in claim 1, wherein said upper includes an annular bottom piece sewn to said bottom side of said annular peripheral portion, and an upper piece connected to said annular bottom piece and disposed above said annular peripheral portion.

9. A footwear comprising:

an outsole including an annular peripheral portion that has a hole-defining surface, a plurality of support portions that respectively extend in directions substantially perpendicular to a longitudinal direction of said footwear, that are each connected at two ends to said annular peripheral portion, and that cooperate with said hole-defining surface of said annular peripheral portion to define a plurality of block-receiving holes, and an annular inner ridge that protrudingly extends from said hole-defining surface of said annular peripheral portion into said block-receiving holes;

an insole including an insole body that is formed with an annular outer groove, and a plurality of wearproof blocks that are connected to said insole body, said insole being formed with a plurality of embedding grooves between adjacent pairs of said wearproof blocks, said insole body being supported by said support portions and said annular peripheral portion with said annular inner ridge received fittingly in said annular outer groove, said support portions received respectively and fittingly in said embedding grooves, and said wearproof blocks received respectively and fittingly in said block-receiving holes, such that said wearproof blocks protrude from a bottom side of said annular peripheral portion; and an upper fixed on said outsole;

wherein one of said support portions that is disposed proximate to a middle section of said annular peripheral portion is greater in size than the remaining one(s) of said support portions; and wherein said upper includes an annular bottom piece sewn to said bottom side of said annular peripheral portion, a connecting piece sewn to said one of said support portions and connected to said annular bottom piece, and an upper piece connected to said annular bottom piece and disposed above said annular peripheral portion.

10. The footwear as claimed in claim 9, wherein said upper includes an annular bottom piece sewn to said bottom side of said annular peripheral portion, and an upper piece connected to said annular bottom piece and disposed above said annular peripheral portion.

11. The footwear as claimed in claim 9, wherein said insole is further formed with a plurality of first draining holes extending through said insole body and said wearproof blocks.

12. The footwear as claimed in claim 11, wherein said support portions of said outsole are formed with at least one first through hole, and said insole body is further formed with at least one second through hole registered with and in spatial communication with said first through hole.

13. The footwear as claimed in claim 9, wherein said insole body and said wearproof blocks of said insole are made of different materials and are molded as one piece.

14. The footwear as claimed in claim 1, wherein said insole is further formed with a plurality of first draining holes extending through said insole body and said wearproof blocks.

15. The footwear as claimed in claim 14, wherein said support portions of said outsole are formed with at least one first through hole, and said insole body is further formed with at least one second through hole registered with and in spatial communication with said first through hole.

16. The footwear as claimed in claim 1, wherein said insole body and said wearproof blocks of said insole are made of different materials and are molded as one piece.

* * * * *